United States Patent [19]

Damron

[11] 4,290,407

[45] Sep. 22, 1981

[54] ARCHERY GUIDING DEVICE FOR ARCHERY BOW

[76] Inventor: William M. Damron, 1145 W. Harvest, Mesa, Ariz. 85201

[21] Appl. No.: 2,224

[22] Filed: Jan. 9, 1979

[51] Int. Cl.[3] ..... F41B 5/00

[52] U.S. Cl. ..... 124/41 A; 124/83; 124/80; 124/88

[58] Field of Search ..... 124/87, 88, 86, 24 R, 124/41 A, 83, 80

[56] References Cited

U.S. PATENT DOCUMENTS

| | | | |
|---|---|---|---|
| 599,747 | 3/1898 | Stoddard | 124/24 R X |
| 1,526,176 | 2/1925 | O'Connell | 124/24 R |
| 3,518,980 | 7/1970 | Hamm | 124/24 R X |
| 4,027,645 | 6/1977 | Damron | 124/24 R |
| 4,146,009 | 3/1979 | Adams | 124/88 |

*Primary Examiner*—William R. Browne

*Attorney, Agent, or Firm*—Warren F. B. Lindsley

[57] ABSTRACT

An improved archery bow with arrow guiding device incorporating a two-section jointed tubular member through which slotted clearance is provided for the passage of the head and fletchings of the arrow, the guiding device being foldable for storage. A hand-and-jawbone butt is provided for stabilizing the bow during the aiming and launching of the arrow.

6 Claims, 13 Drawing Figures

ARCHERY GUIDING DEVICE FOR ARCHERY BOW

BACKGROUND OF THE INVENTION

This invention relates to guiding and launching tubes for use in conjunction with archer bows and arrows.

1. Field of the Invention

This invention is directed to a tubular guiding and launching device useable in conjunction with conventional bows and arrows but is particularly useful in launching much shorter arrows such as arrows of 3 or 4 inches in length.

2. Description of the Prior Art

Heretofore arrow launching tubes have been designed for attachment to somewhat unconventional bows which assist the archer in holding, launching and guiding an arrow through the tube in a controlled path of trajectory toward the target.

Some of these launching tubes were too short in length to provide even a small degree of guidance for a conventional length arrow. Others long enough to provide some guidance of the arrow were quite complicated consisting of a number of parts that would be expensive to fabricate and difficult to attach to a conventional bow without necessitating considerable alteration of the bow. These launching tubes required a large diameter bore in order for a broadhead hunting tip and the fletchings or feathers of the arrow to pass through the tube without excessive friction and damage to the same, thereby decreasing the degree of guidance the launching tube could provide for the flight of the arrow.

An important arrow guiding device described in U.S. Pat. No. 4,027,645 by the inventor of the present invention partially overcomes the limitations of the earlier devices. This device, which is suitable for use with short or long arrows comprises a two-section tubular assembly that may be attached to a conventional bow. The longer of the two sections is detachable to facilitate carrying and storage. The guiding tube is slotted to provide clearance for a broadhead hunting tip and for the vertically-directed fletchings. There remain, however, opportunities for improvements. Detachment of the longer section is less convenient than might be desired. The device also fails to provide clearance for the horizontally-projecting fletchings, and the resulting interference between these fletchings and the guide tube produces an undesirable amount of drag which reduces the velocity of the arrow.

SUMMARY OF THE INVENTION

In order to obviate the disadvantages and incapabilities of the above described types of arrow launching tubes, a new and improved guiding and launching tube assembly is provided consisting of a two-section jointed guiding tube with provision for quickly pivoting the longer of the two sections into a folded position for convenience in carrying or storage. A secure locking or latching means also permits the instant restoration of the tube to its working position. Additional slots or grooves are provided as clearance for the horizontal fletchings, and a hand-and-jawbone butt is added for steadying the device for aiming and shooting. The launching tube assembly provides an aligned arrow guiding means the full length of the connected tubes and employs a bowstring holding or resting means in the rear portion of the launching tube assembly.

It is, therefore, one object of this invention to provide a new and improved lightweight, inexpensive arrow guiding and launching device the front end of which is detachably secured to the side of a conventional archery bow in proper relationship to its spine-point for supporting, guiding and launching an arrow.

Another object of this invention is to provide a new and improved arrow launching tube assembly comprising two jointed tubular parts one of which may be detachably secured to the side surface of a conventional archery bow at its spine-point or made a permanent integral part of the bow and the other of which is pivotally secured in longitudinal aligned relationship with the rear end of the first part to form an extension of the launching tube.

A still further object of this invention is to provide an improved guiding and launching device for long or short arrows comprising two jointed tubular sections one of which is provided with attaching means for securing its front end to the side surface of an archery bow in rearwardly extending perpendicular relationship thereto and provided at its rear end with a locking hinge to which the second section is secured. Through the utilization of the locking hinge the second section may quickly and conveniently be folded for storage or restored again to its working position in which the two slotted longitudinally aligned tubular sections provide a continuous passage throughout the length of the launching device, the slots providing clearance for the head of the arrow and for its vertically and horizontally extending fletchings.

A still further object of this invention is to provide an improved guiding and launching device that may be used in conjunction with arrows of any desired length and a conventional archery bow for controlling the flight pattern of the arrows and employing means for resting and holding the bowstring subsequent to the launching of the arrow.

A still further object of this invention is to provide an improved guiding and launching device that may be used in conjunction with a conventional archery bow in which a hand-and-jawbone butt is incorporated for use in steadying the bow and the attached device during the aiming and shooting of the arrows and also for removing the strain from the arms prior to the releasing of the bowstring.

Further objects and advantages of the invention will become apparent as the following description proceeds and the features of novelty which characterize this invention will be pointed out with particularity in the claims annexed to and forming a part of this specification.

DESCRIPTION OF THE PREFERRED EMBODIMENT

Figures 1, 2, 4, 5, 6, 7, 8A, 8B, 8C:
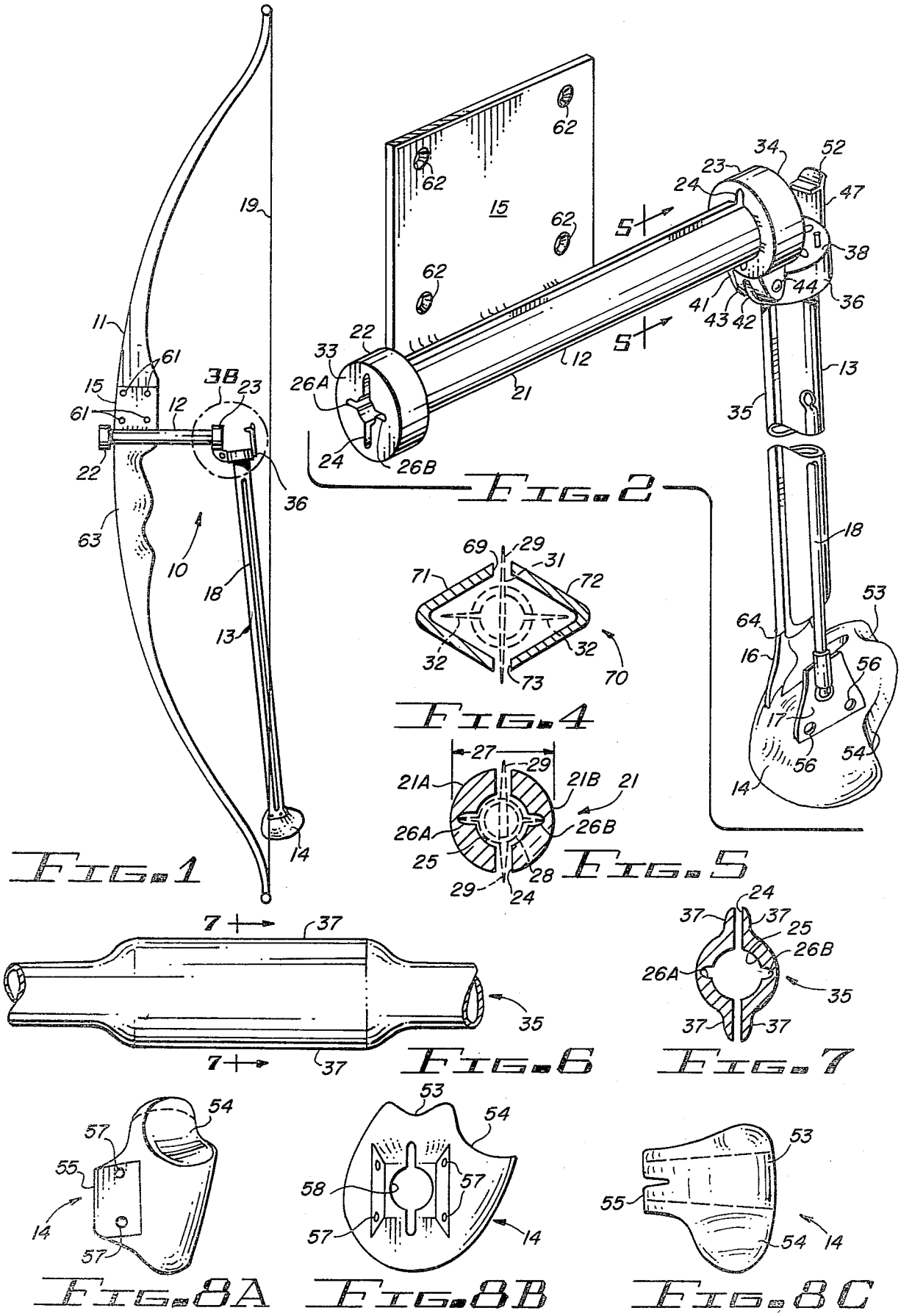
FIG. 1 is a side elevational view of a conventional archery bow with the arrow guiding device attached and folded for carrying or storage.
FIG. 2 is an enlarged perspective view of the folded arrow guiding device as detached from the archery bow.
FIG. 4 is a cross-sectional view of an alternate construction of the main body or tube of the guiding and launching device.
FIG. 5 is a cross-sectional view of the forward tube section of the device of FIG. 2 taken along line 5—5 of that figure.
FIG. 6 is a side view of a portion of the main body of the device which has been specially shaped to protect the hand of the archer against the possibility of being cut or grazed by the head of the arrow as it is launched from the device.
FIG. 7 is a cross-sectional view of the body section of FIG. 6 taken along line 7—7 of that figure.
FIG. 8A, 8B and 8C are different views of the hand-and-jawbone butt member.

Referring more particularly to the drawing by characters of reference, FIG. 1 discloses an improved arrow guiding and launching device 10 attached in operable relationship to one side of a conventional archery bow 11. The device 10, which has been folded for convenience in carrying or storage, comprises a forward tube section 12, a rear tube section 13, and a hand-and-jawbone butt member 14. The forward end of tube section 12 is attached to the side of bow 11 by means of a flat rectangular mounting plate 15, one edge of which is welded to the inboard side of tube section 12. The rear end of tube section 12 and the forward end of tube section 13 are formed into mating joint members at the circled area identified in FIG. 1 by the notation 3B. Butt member 14 is secured to the rear end of tube section 13 by means of a thin curved plate 16 on the far side and by a combination of a thin plate 17 and a long rod 18 on the near side. The usual draw string 19 of the bow is captured between the rod 18 and the body of tube section 13.

Figure 9:
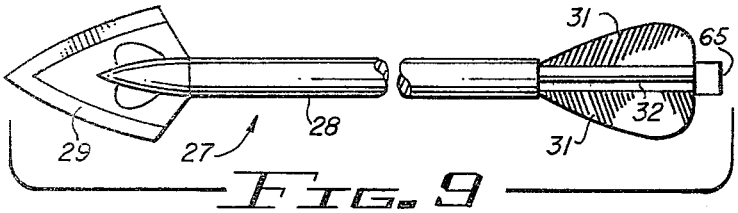
FIG. 9 is an elevational side view of a hunting arrow of the type with which the guiding and launching device is intended to be employed.
Figure 10:
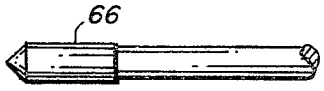
FIG. 10 is an elevational view of the tip of a target arrow of a type with which the guiding and launching device of the invention may also be employed.
Figure 3A:
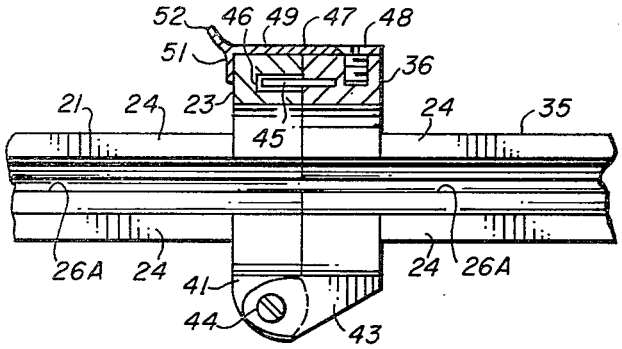
FIG. 3A is a cross-sectional side view of the joint section which pivotally secures together the two sections of the arrow guiding device, the view of FIG. 3A showing the joint in the locked or working position of the device.

Tube section 12 comprises a slotted tubular body 21 terminated by a forward flange 22 and a rear flange 23. As shown by the cross-sectional view of FIG. 5, the tubular body 21 is split into left and right halves, 21A and 21B by a vertical slot 24 which extends all the way through member 21. A center circular bore 25 extends longitudinally the length of body 21. Two additional internal slots or grooves 26A and 26B extend horizontally from inside bore 25 cutting into the walls of body 21 but not totally penetrating to the outside. The slots 26A and 26B extend longitudinally the full length of body 21 and they are positioned directly opposite each other in a horizontal plane bisecting the center of body 21 as shown in FIG. 5. The longitudinal slotted bore thus provided in body 21 provides clearance for an arrow 27 as shown in FIG. 9 wherein the bore 25 provides clearance for the shaft 28 of the arrow 27, the vertical slot provides clearance for the side edges of the broadhead tip 29 and for the vertically-extending fletchings 31. The horizontal grooves 26A and 26B provide clearance for the horizontally-extending fletchings 32.

The forward and rear flanges 22 and 23, respectively, are formed as thick discs, axially aligned with the cylindrical body 21. The bore 25 and the horizontal slots 26A and 26B extend longitudinally through flange 22 to the flat forward surface 33 which is precisely perpendicular to the longitudinal axis of body 21. The vertical groove 24 also extends longitudinally through flange 22 to surface 33 but its upper and lower penetrations in flange 22 fall short of totally penetrating to the outside diameter so that a cross-shaped pattern results as shown in FIG. 2. The slots 24 and 26 extend in the same manner through flange 23 to a rear flat surface 34. The flanges 22 and 23 may be machined integrally with body 21 or they may be welded together therewith or in some other manner joined together so that the flanges support the body members 21A and 21B in their desired relative positions.

Tube section 13 comprises a split body 35 and a forward flange 36. Body 35 may have a uniform cross-section along its entire length matching the bored and slotted cross-section of body 21 as shown in FIG. 5, or it may be provided over a portion of its length with ridges 37 at both sides of the vertical slot 24 as shown in FIGS. 6 and 7. The ridges 37 serve as guards over portions of the length of body 35 providing protection to the archer's hand against injury from the sharp edges of the broadhead tip 29 of the arrow. The slotted interior bore of body 35 again provides clearance for the arrow.

The flange 36 at the forward end of body 35 is similar to flanges 22 and 23. It has an identical slotted center bore for clearance of the arrow, and it has a flat forward surface 38 which is perpendicular to the axis of body 35.

Figure 3B:
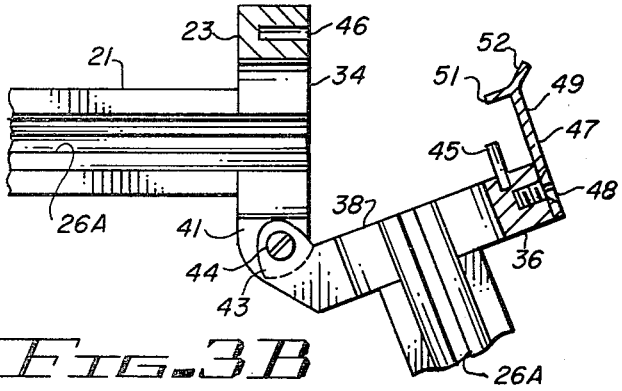
FIG. 3B is a cross-sectional side view of the same joint section but shown here in the folded position of the device as shown also in area 3B of FIG. 1.

The rear flange 23 of tube section 12 and the forward flange 36 of tube section 13 are adapted to form a joint as shown in FIGS. 1, 2, 3A and 3B that pivotally secures the two sections together. Projecting downward from the underside of flange 23 are two flat parallel tabs 41 and 42, their plane surfaces aligned vertically and longitudinally with the axis of body 21. Tabs 41 and 42 are spaced apart sufficiently to receive between the two of them a similar flat tab 43 which extends downward from flange 36 and which is aligned longitudinally with the axis of body 35. Tab 43 is positioned between tabs 41 and 42 and a pin 44 passes through aligned holes in the three tabs to form the pivoting joint which permits the two sections 12 and 13 to be broken or folded as shown in FIGS. 1, 2 and 3B, or straightened to the aligned working position of FIG. 3A in which the flat surfaces 34 and 38 are in intimate contact with each other and the axes of sections 12 and 13 are longitudinally aligned so that a continuous grooved passage for the arrow is provided from the rear end of section 13 through the forward end of section 12. A metal guide pin 45 projecting perpendicularly from surface 38 fits into a mating hole 46 which penetrates perpendicularly through surface 34 into flange 23, the pin 45 enhancing the accuracy of the alignment of sections 12 and 13 in the working position.

A latching clip 47 is attached by screws 48 to the top surface of flange 36. Clip 46 has a main body 49 in the form of a flat strip of spring steel which extends rearwardly from its anchorage at screw 48 passing over the top surface of flange 23 in the working position shown in FIG. 3A. At the forward edge of flange 23 a tab 51 extends perpendicularly downward from body 49, the tab 51 gripping the forward surface of flange 23 and effectively locking flange 23 against flange 26. A finger grip 52 extending forward and upward from the base of tab 51 is utilized to raise body 49 from the top surface of flange 23 and thereby to release tab 51 and clip 47 to permit the folding of device 10.

The hand-and-jawbone butt member 14 as shown in FIGS. 1 and 2, and in more detail in the side, end and top views, respectively, of FIGS. 8A, 8B and 8C, is specially shaped and contoured for being gripped by the hand and rested against the chin or jawbone of the archer as he aims and shoots the arrow. Member 14 is generally bulb-shaped with a minor depression 53 contoured to fit the thumb and with a major depression 54 contoured to fit the side of the chin or jawbone. The forward end 55 of member 14 is tapered for attachment to plates 16 and 17. As is apparent from the end view of FIG. 8B a grooved bore 58 extends through member 14 in alignment with the similar longitudinal opening through sections 12 and 13. Plates 16 and 17 are attached, each to one side of the tapered end 55 of member 14 by screws 56 which thread into holes 57 in member 14. Plate 16, visible in FIG. 2 but not totally shown in the drawing has its forward end secured by welding or other means to the rearward side surface of body 35. Plate 17 serves as a point of attachment for the rear end of rod 18, the front end of rod 18 being attached to the side of body 35 near the forward end of that member. The manner of attachment of rod 18 to body 35 is such as to cause rod 18 to be aligned longitudinally with body 35 along its left side with clearance provided between rod 18 and the surface of body 35 to receive the draw string 19 during certain phases of the use of the device 10, as, for example, when the device 10 is folded for storage in the illustration of FIG. 1.

To attach the device 10 to a standard bow 11, it is only necessary to flatten the side surface of the bow covered by the plate 15 as shown in FIG. 1 and then to secure the plate to the flattened surface by means of four screws, 61 which are passed through the holes 62 of plate 15.

In the use of the device 10 with the bow 11, the archer first raises or unfolds section 13 to the horizontal working position in which it is aligned with section 12. Latch 47 will automatically engage the top surface of flange 23 to secure or lock section 13 into the working position. The draw string 19 is then drawn back to the rear end of body 35 and set into a notch 64 provided at the end of body 35 for holding the draw-string in the fully taut position. This action is equivalent to the cocking of a gun. The arrow 27 is then inserted, tip first, through the grooved bore 58 of member 14 into tube section 13. The arrow is manually moved forward into section 13 until its nock 65 is just barely exposed at the rearward end of body 35. The archer then grips the contoured hand-grip area 63 of bow 11 with his left hand, and raises the bow 11 in the normal manner, directing it toward the intended target. With his right hand he grips butt member 14, positioning his thumb in depression 53. As he aligns the bow 11 and device 10 for sighting the target he moves member 14 toward his jaw, the depression 54 coming to rest comfortably against his jawbone. In this position the bow 11 and the attached device 10 are easily steadied against unwanted motion as the archer draws the bowstring from notch 64, places it into the nock 65 of arrow 27, takes aim and then releases the bowstring to shoot the arrow. During the setting and releasing of the drawstring at this stage only the fingers of the right hand are stressed because the ball of the right hand is supported by the rear surface of member 14. The attendant relief of the aim muscles from the stress of the tightened drawstring 19 enables the archer to achieve a higher degree of relaxation during the sighting and shooting operation and the accuracy of the operation is as a consequence significantly enhanced.

As the arrow passes through the grooved bore of device 10, the protruding edges of the tip 29 and the fletchings 31 and 32 pass with little resistance through the slots or grooves 24, 26A and 26B so that a high arrow velocity is achieved in a direction which is accurately determined by virtue of the effectiveness of the arrow guiding device 10.

It will be recognized that while the device 10 has been designed for an intended utilization with the hunting arrow 27 of FIG. 9, other types of arrows may be used in the same device. An arrow having a target tip 66, for example, will be equally as well guided by the bore 25. Even though the tip has no protruding edges, the tip itself substantially fills the bore 25 and the fletchings fit readily into the grooves 24, 26A and 26B so that the direction and course of the arrow are controlled as before during its acceleration and release.

A second embodiment of a portion of the arrow guiding device of the invention is shown in FIGS. 4, 11, 12 and 13.

FIG. 4 shows the cross-section of an alternate construction for an arrow guiding tube 70. In this construction two V-shaped channels 71 and 72 are positioned in parallel relationship with each other, their V-shaped openings facing each other. Channels 71 and 72 are spaced slightly apart so that their separation 69, 73 provides clearance for the projecting edges of the tip 29 and for the vertical fletchings 31. The horizontal fletchings 32 find clearance inside the valleys of sections 71 and 72. It should be noted that FIGS. 4 and 5 show a clearance between the shaft of the arrow and the inside surface of the guiding tube for sake of clarity but in practice the clearance will be about twenty thousandths of an inch.

Figure 11:
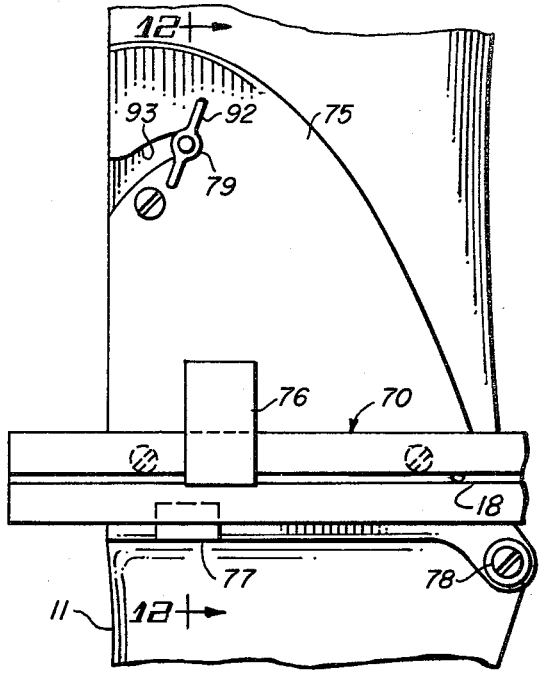
FIG. 11 is a partial side view of the joint section of an alternate construction of the guiding and launching device of the invention, the joint shown in the locked or working position of the device.
Figure 12:
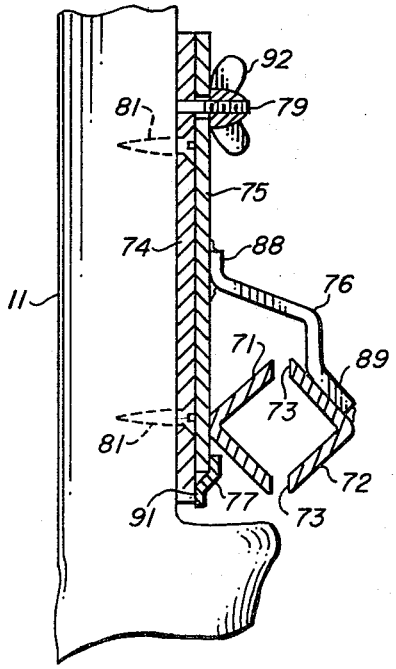
FIG. 12 is a cross-sectional view of the joint section of FIG. 11 taken along line 12—12 of that figure.
Figure 13:
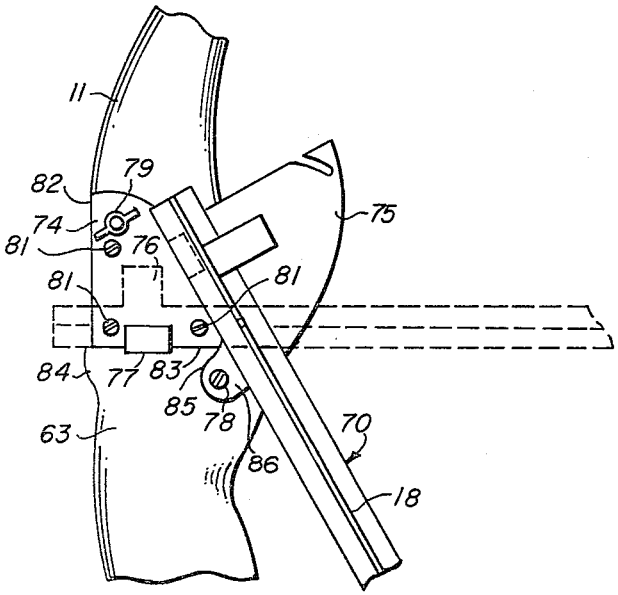
FIG. 13 is a partial side view of the joint section of FIG. 11 but shown here in the folded position.

In this embodiment of the invention, the guiding tube 70 is in one section instead of two and it is pivotally mounted at its attachment to bow 11 as shown in FIGS. 11, 12 and 13.

The mounting means for tube 70 comprises a base plate 74, a carriage plate 75, a tube support bracket 76, an edge grip 77, a pivot screw 78, and a locking screw 79.

The base plate 74 is a flat plate with an outline that is in the general form of a right triangle except that the hypotenuse is curved outwardly rather than straight. Plate 74 is attached by means of wood screws 81 to a flattened surface on the left-hand side of bow 11 just above the hand-grip area 63. The two sides 82 and 83 of plate 74 which form a right angle are oriented vertically and horizontally respectively at the side of the raised bow 11. The vertical side 82 is flush with the back 84 of bow 11 and the horizontal side 83 runs perpendicularly rearward from the back of the bow.

A curved downard extension 85 of plate 74 at its lower right-hand corner provides a pivotal mounting point for carriage plate 75.

Plate 75 has the same general outline as plate 74. Plate 75 has an extension 86 at its lower right-hand corner. When plate 75 is laid over plate 74 the extension 85 is superposed by the extension 86 and corresponding holes in the two extensions are aligned. The pivot pin 78 passes through the aligned holes in extensions 85 and 86 to serve as a pivotal mounting means for plate 75.

Channel 71 is secured near its forward end to plate 75, the apex of its V-shaped cross-section being welded to plate 75 in alignment with the horizontal edge of plate 75 as viewed in FIGS. 11 and 12. Channel 72 has its forward end secured to plate 75 by means of the specially-shaped bracket 76 which has its one end 88 welded to plate 75 and its other end 89 welded to channel 72. The rearward ends of channels 71 and 72 may be secured in their relative positions by any suitable mutual mounting means which may again incorporate or support a butt member 14 and its associated supporting hardware.

In the superposed positions of plates 74 and 75 the lower horizontal edge of plate 74 extends somewhat below the lower horizontal edge of plate 75. Near the left-hand side of this extension of plate 74 the edge grip 77 is mounted. The lower edge 91 of grip 77 is welded to the lower edge of plate 74 as shown in FIG. 12. From its welded edge grip 77 extends in a dog-leg cross-section outward and upward to form a slot into which the lower edge of plate 75 is captured when plate 75 is rotated counter-clockwise. A limit point for the rotation of plate 75 is thus established by grip 77.

The locking screw 79 extends perpendicularly from plate 74 at a point near its upper left-hand corner. Screw 79 carries a wing-nut 92. A curved slot 93 in plate 75 clears screw 79 during the last portion of counter-clockwise rotation of plate 75 prior to its engagement by grip 77. With wing-nut 92 partially backed off, the slotted portion of plate 75 also passes under wing-nut 92. In the raising of tube 76 to its working position it may now be seen that plate 75 carrying tube 70 is rotated counter-clockwise until slot 93 engages screw 79 and comes to a halt when grip 77 engages the lower edge of plate 75. At this point wing-nut 92 is tightened to secure the position of plate 75 and tube 72 in the working position.

Except for the procedure just described for effecting a folded storage position an extended working position for the arrow guiding tube 70, the utilization of the device 10 with the tube 70 and its associated mounting hardware is the same as described for the first embodiment of the invention.

FIG. 12, for sake of clarity, shows the axis of the guiding tube spaced farther from the surface of plate 75 than necessary and in production the legs of channel 71 may be shortened to place the longitudinal axis of the arrow closer to the bow.

The stated objects of the invention are thus met as described in two variations and although but two embodiments of the invention have been illustrated and described, it will be apparent to those skilled in the art that various changes and modifications may be made therein without departing from the spirit of the invention or from the scope of the appended claims.

What is claimed is:

1. A guiding and launching device for arrows comprising:

a hollow launching tube assembly, attachment means for fastening said assembly at one end thereof to the spine point of a bow, means attached to a bow for pivotally moving at least a part of said assembly relative to the longitudinal axis of a bow for moving at least a part of said assembly into arrow launching position and to a position adjacent the longitudinal axis of a bow for carrying and storage purposes, and a butt member fastened to the other end of said assembly for engaging the jawbone of a user when said assembly is in arrow launching position.

2. The guiding and launching device set forth in claim 1 wherein:

said butt member is provided with an opening therethrough which is aligned with the hollow interior of said assembly and through which an arrow is inserted into said assembly.

3. A guiding and launching device for arrows comprising:

a hollow launching tube assembly, attachment means for fastening said assembly at one end thereof to the spine point of a bow, and means attached to the bow for pivotally moving at least a part of said assembly relative to the longitudinal axis of a bow for moving at least a part of said assembly into arrow launching position and to a position adjacent the longitudinal axis of a bow for carrying and storage purposes, said assembly comprising a hollow tubular configuration split along opposite ends of a first diameter of said assembly along its length and provided with an internal slot along a second diameter of said assembly arranged substantially perpendicular to said first diameter whereby the tips of an arrow head and its fletchings protrude into said split and said slot for guiding of a arrow through the guiding and launching device.

4. A guiding and launching device for arrows comprising:

a hollow launching tube assembly, attachment means for fastening said assembly at one end thereof to the spine point of a bow, and means attached to a bow for pivotally moving at least a part of said assembly relative to the longitudinal axis of a bow for moving at least a part of said assembly into arrow launching position and to a position adjacent the longitudinal axis of a bow for carrying and storage purposes, said assembly comprising a first hollow tubular portion and a second hollow tubular portion coaxially aligned with and pivotally connected to said first tubular portion, the portions of said assembly being split along opposite ends of a first diameter of said assembly along its length and provided with an internal slot along a second diameter of said assembly arranged substantially perpendicular to said first diameter, whereby the tips of an arrow head and its fletchings protrude into said split and slot for guiding of an arrow through the guiding and launching device.

5. The guiding and launching device for arrows set forth in claim 4 in further combination with:

bowstring positioning means mounted on the outer periphery of said second hollow tubular portion and extending from the end closest to the user when in use toward said first hollow tubular portion for positioning of the bowstring prior to manual removal of a bowstring therefrom for releasing to cause an arrow in the tube assembly to be launched.

6. The guiding and launching device set forth in claim 5 in further combination with:

a butt member fastened to the free end of said second member for engaging the jawbone of a user when said assembly is in arrow launching position, said butt member being provided with an opening therethrough which is aligned with the hollow interior of said tube assembly and through which the arrow is inserted into said tube assembly, and said butt member being further provided with groove means for holding and supporting the palm and fingers gripping the bowstring of an associated bow.

* * * * *